US005179237A

United States Patent [19]

Grossman

[11] Patent Number: 5,179,237

[45] Date of Patent: Jan. 12, 1993

[54] SLEEVED METAL DRUMSTICK

[75] Inventor: Richard D. Grossman, Canoga Park, Calif.

[73] Assignee: Easton Aluminum, Inc., Van Nuys, Calif.

[21] Appl. No.: 748,022

[22] Filed: Aug. 21, 1991

[51] Int. Cl.[5] ..... G10D 13/02

[52] U.S. Cl. ..... 84/422.4

[58] Field of Search ..... 84/422.4

[56] References Cited

U.S. PATENT DOCUMENTS

| | | | |
|---|---|---|---|
| 3,489,052 | 1/1970 | Colyer et al. | 84/422.4 |
| 3,722,350 | 3/1973 | Cordes | 84/422.4 |
| 3,958,485 | 5/1976 | Peters | 84/422.4 |
| 4,246,826 | 1/1981 | Warrick et al. | 84/422.4 |
| 4,320,688 | 3/1982 | Donohoe | 84/422.4 |

*Primary Examiner*—Michael L. Gellner
*Assistant Examiner*—Cassandra C. Spyrou
*Attorney, Agent, or Firm*—Roth & Goldman

[57] ABSTRACT

A non-breakable metal drumstick having a replaceable sheath of plastic material thereon to prevent damage to drums and cymbals, constructed to minimize vibration ordinarily associated with metal drumsticks.

15 Claims, 4 Drawing Sheets

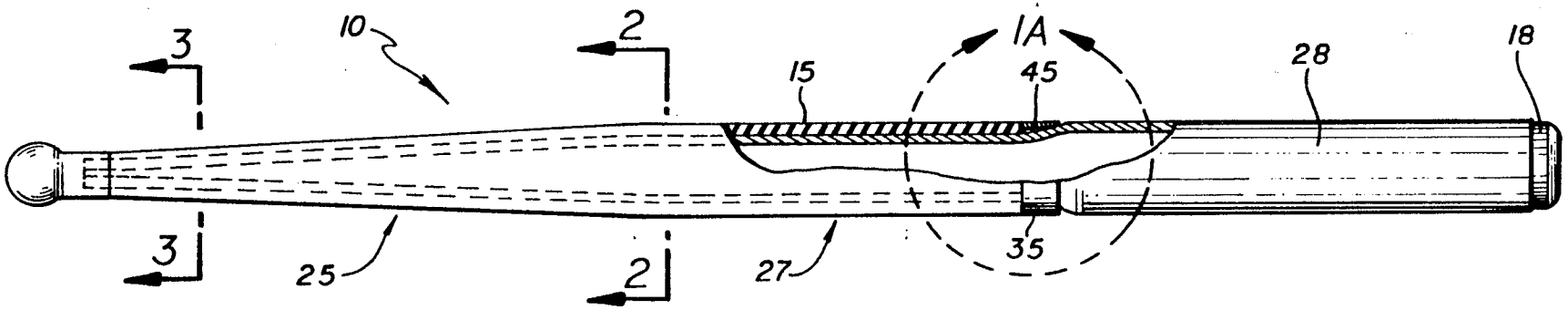
FIG. 1
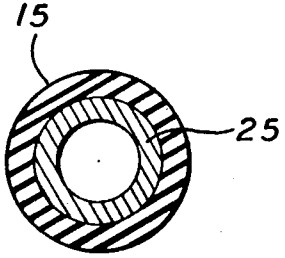
FIG. 2
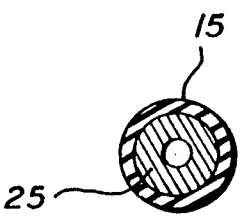
FIG. 3
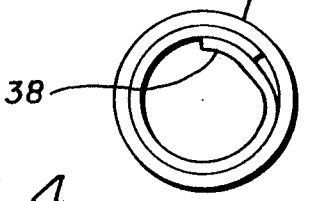
FIG. 4
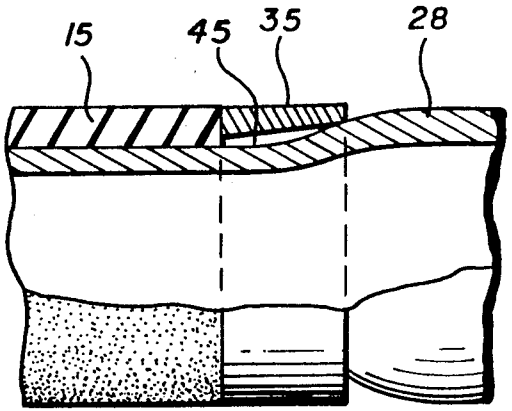
FIG. IA

SLEEVED METAL DRUMSTICK

BACKGROUND OF THE INVENTION AND PRIOR ART

1. Field of the Invention

This invention relates in general to drumsticks and in particular to improved metal drumsticks which approximate the playing characteristics of wood drumsticks but which do impart minimal damage to drums and cymbals and which have a replaceable elastomeric wear sleeve and a tapered body with low vibration.

2. Prior Art

Most drumsticks are made of wood with a specific weight and a center of gravity located at about 45% to 50% from the handle end. The advantages of wood drumsticks are that they have the "wood feel" because of their light weight, flexural characteristics and specific center of gravity. The disadvantages of wood drumsticks are their lack of durability, the damage they impart to drums and cymbals and their inadequate strength.

Metal drumsticks on the other hand are stronger and can be manufactured with more uniformity from stick to stick, but are more prone to vibration and are generally heavier and have centers of gravity differently located than those of wood drumsticks. They also can cause undesireable vibrations and reverberations which are tiring to the drummer and tend to damage cymbals and drums because of their relatively hard surface as compared with wood. Numerous patents have attempted to alleviate the problems of non-wood drumsticks while maintaining their advantages.

U.S. Pat. No. 3,722,350 dated Mar. 27, 1973 to Courdes discloses a hollow cylindrical metal drumstick having a straight, cylindrical tip end portion of reduced diameter. A plastic coating or sleeve may be disposed on the larger diameter cylindrical portion of the drumstick but not on the reduced diameter portion since it is said that such a coating in this area would inhibit the desired degree of flexibility (Col. 3, lines 13–17).

U.S. Pat. No. 4,385,544 issued May 31, 1983 to Roland E. Heiskell discloses a drumstick made of rolled impregnating fabric with a center of gravity positioned at 43.75 to 46.875% of the drumstick length from the handle end.

U.S. Pat No. 3,958,485 issued May 25, 1976 to Thomas 0. Peters discloses a hollow drumstick with internal ribs for increasing stiffness and a vibration dampener to eliminate vibrations.

U.S. Pat No. 4,320,688 issued May 23, 1988 to David G. Donohoe discloses a synthetic drumstick made of fiber-impregnated plastic material for lighter weight with the center of gravity toward the striking area.

In the prior art there have been numerous attempts to make non-breakable drumsticks that are cheaper, more durable, more uniform, while minimizing vibrations and which do not damage drums or cymbals while retaining a "wooden feel", but in no case have all these objectives been fully accomplished.

SUMMARY OF THE INVENTION

The present invention accordingly provides a drumstick comprised of an elongated metal core having a handle portion, an impact end and a tapered portion extending between the handle portion and the impact end; an elongated elastomeric sleeve removably mounted on said tapered portion of said metal core; and a rounded striking tip affixed to the impact end of said core.

BRIEF DESCRIPTION OF THE DRAWINGS

FIG. 1 is a plan view, partly broken away, of a drumstick constructed in accordance with the teachings of the present invention.

FIG. 1A is an enlarged view of the circle IA of FIG.

FIG. 2 is an enlarged cross-section, the plane of which is indicated by the lines 2—2 of FIG. 1.

FIG. 3 is an enlarged cross-section, the plane of which is indicated by the lines 3-3 of FIG. 1.

FIG. 4 is a right end view of the drumstick with the stick end cap removed to show a vibration dampener in the handle of the drumstick.

DESCRIPTION OF THE PREFERRED EMBODIMENT

Figure 7:
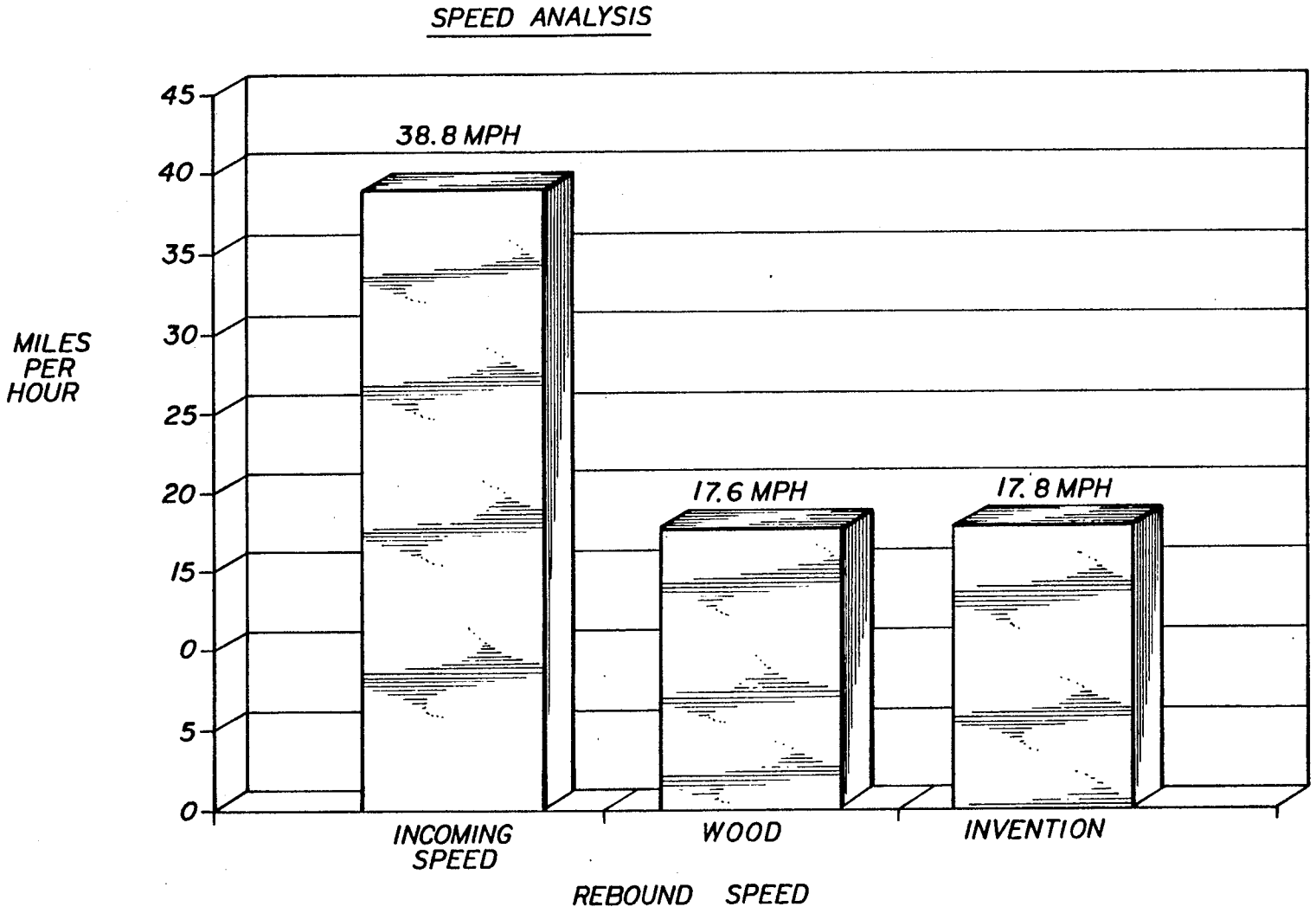
FIG. 7 is a graph of drumstick rebound speed characteristics.

Referring to FIG. 1 of the drawing, the drumstick has an elongated metal core 10, an axially pre-stressed elongated elastomeric sleeve 15 mounted thereon. A slip ring 35 having a tapered wall thickness which will be described later and a rounded striking tip 11 which engage opposite ends of the sleeve 15 axially confine it therebetween. The elongated metal core also has a handle portion 28, an impact end 21 and a tapered portion 25 extending from the impact end 21 toward the handle portion 28 and terminating in a cylindrical section 27 of the core which has a diameter slightly less than the diameter of the handle portion 28.

In the embodiment illustrated, the hollow elongated metal core 10 is made of aluminum or aluminum alloy and has a wall thickness of the tapered portion 25 which increases from the cylindrical section 27 to the impact end. In general, the wall thickness will increase from about 0.030" to 0.100" to emulate a 5B TYPE (lighter) drumstick and will increase from 0.035" to 0.125" to emulate a 2B TYPE (heavier) drumstick. Increased wall thickness of the tapered core 15 as the diameter is reduced toward the impact end 21 compensates for reduced strength which ordinarily follows a reduction in diameter.

The impact end 21 of the metal core 10 is so made as to allow the rounded striking tip 11 to be tightly but removably press fit thereon. The rounded striking tip Il is made of a nylon plastic material and has a radially extending abutment shoulder to abut and retain the sleeve 15 on the tapered portion 25 of the metal core.

As best seen in FIG. 1, the slip ring 35 has a tapered wall thickness with a radially extending sleeve abutment shoulder on the thicker end of the slip ring 35. The slip ring 35 is removably mounted on the drumstick core 10 and is positioned at the transition of the handle portion 28 to the cylindrical portion 27 of the metal core with the engagable abutment shoulder facing toward the cylindrical portion 27 of the metal core. As is best seen in FIG. IA, the inside surface of slip ring 35 engages the transition between the handle portion and the cylindrical portion 27 of the metal core 10 for about 20% of its length and a clearance or gap 45 exists between the inside surface of the ring 35 and the outer surface of the metal core 10. The gap 45 is believed to result in more effective prestressing of the elastomeric sleeve and tests have indicated that this in turn results in optimum vibration dampening by a mechanism not fully understood. The preferred material for the slip ring 35 is aluminum or plastic such as DELRIN.

The elongated hollow elastomeric sleeve 15 has a Shore Hardness in the range of from 85A–60D and preferably 91A and is injection molded and removably mounted on the tapered portion 25 and the cylindrical portion 27 of the metal core 10. The sleeve 15 is made of a urethane material and has a wall thickness that preferably decreases from the cylindrical portion 27 to the impact end 21 of the tapered portion to maintain the balanced weight of the drumstick. The wall thickness of the sleeve 15 preferably decreases from 0.050" to 0.040" The sleeve 15 is preferably axially pre-stressed by forces created by confining the sleeve 15 on the tapered portion 25 of the metal core and between the engagable abutment shoulders of the slip ring 35 and the striking tip 11.

The handle portion 28 of the drumstick has a hollow interior and is preferably provided with a roughened, e.g., knurled or shot-peened, exterior for a superior grip. The hollow handle portion is cylindrical rather than tapered and has a constant wall thickness. Vibrations due to the hollowness of the metal core 10 cause hand fatigue with prolonged play. Therefore, a vibration damping material 38 may be inserted inside the hollow handle portion 28 in order to dampen the vibration. The vibration damping material 38 is preferably a flat rectangular sheet of flexible rubberized material rolled greater than 360° to provide overlapping of its edges which unexpectedly improves vibration damping. Finally, an adjustable counterbalancing cap 18 is press fit into the rear open end of the handle portion which can also be fitted with different balance weights (not shown) such that the balance point of the drumstick can be adjusted within the range of from 40–55% as measured from the handle end.

Figure 5:
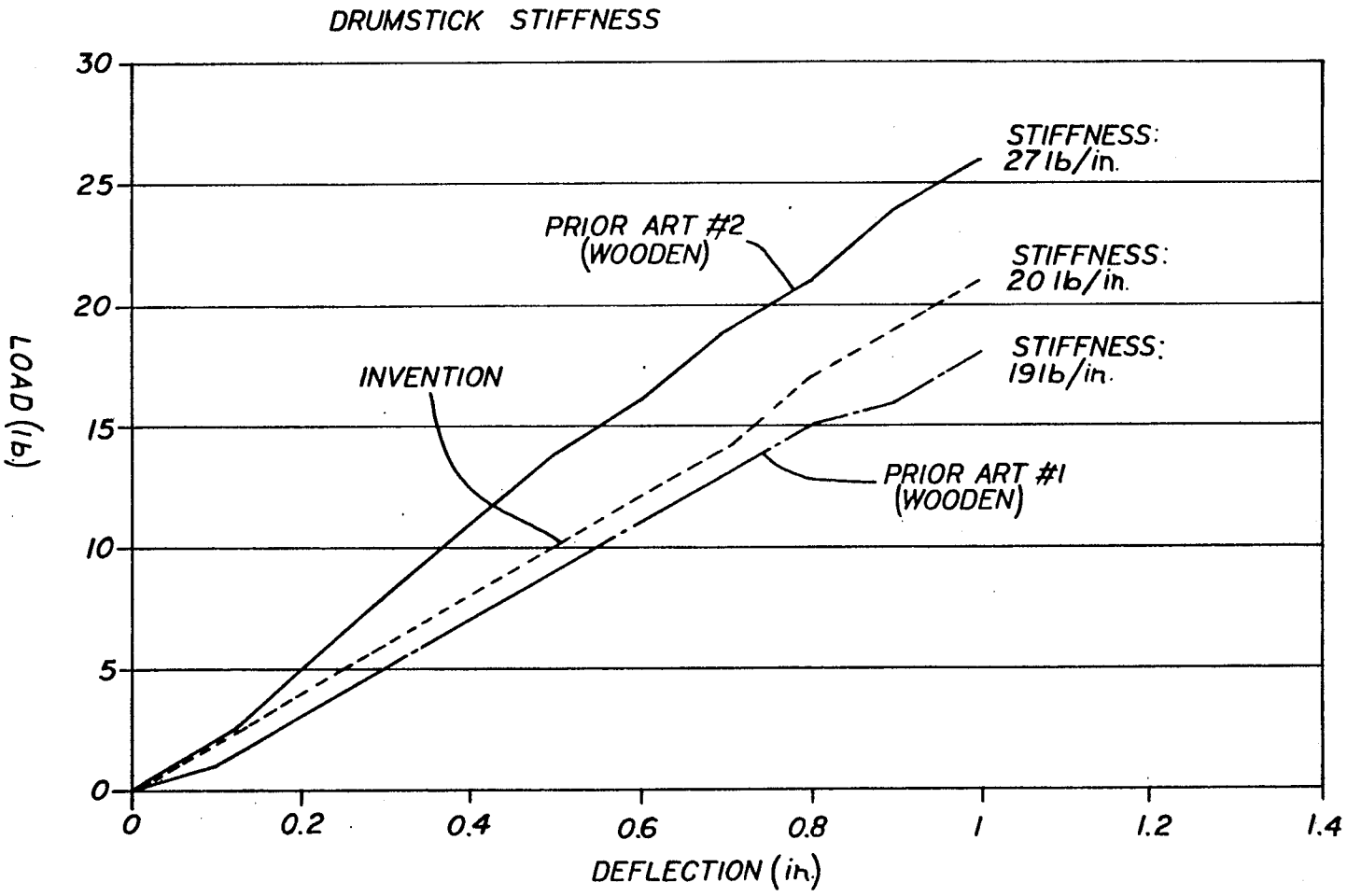
FIG. 5 is a graph of drumstick stiffness characteristics.

Referring to FIG. 5, the graph shows the stiffness characteristics of metal core drumsticks constructed as described herein as compared with that of two different prior art wooden drumsticks. The graph illustrates the load in pounds with respect to deflection in inches. As is evident from the graph, the metal core drumstick disclosed herein has a stiffness characteristic which approximates that of the prior art wooden drumsticks.

Figure 6:
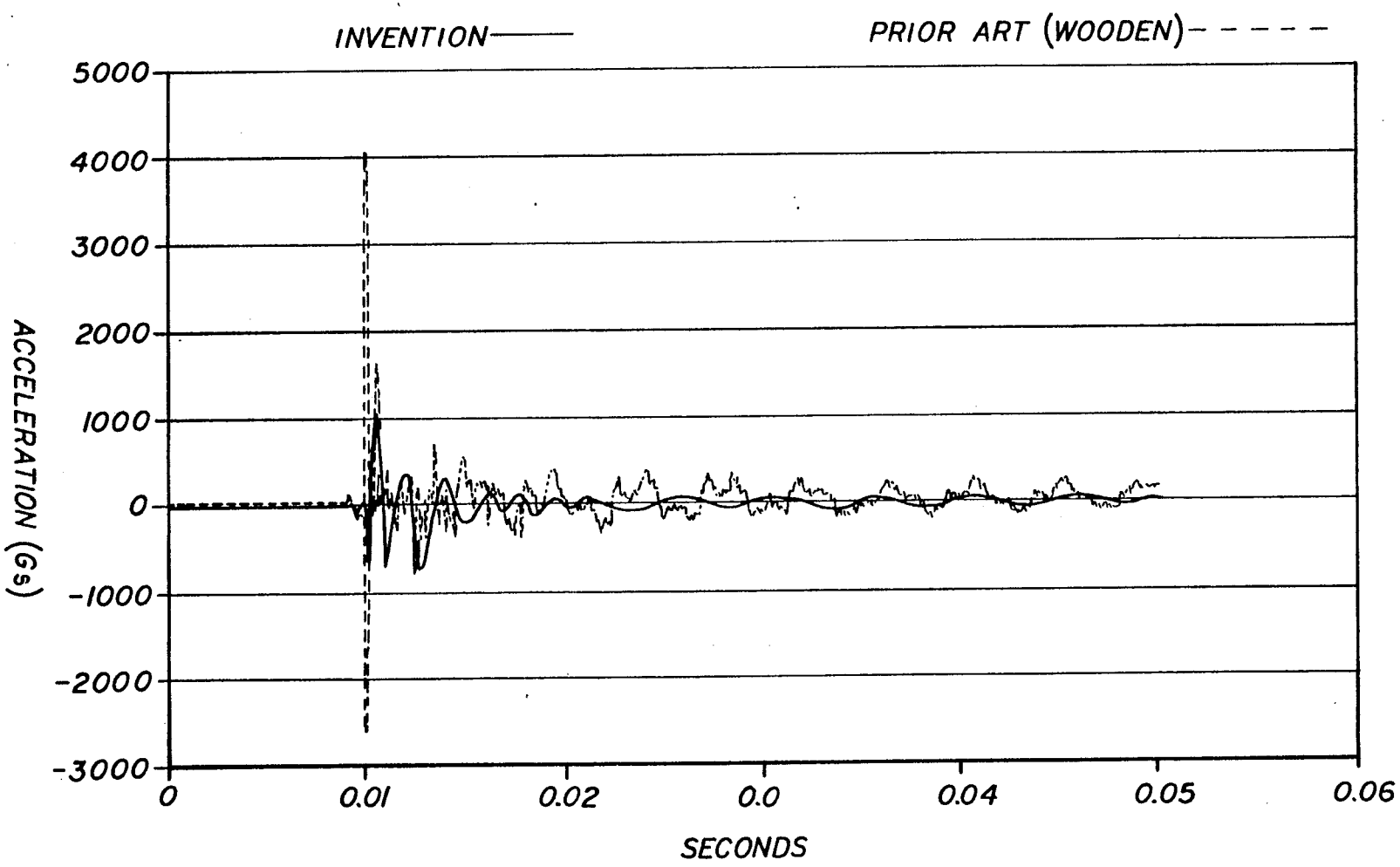
FIG. 6 is a graph of drumstick vibration damping characteristics.

Referring to FIG. 6, the graph shows the vibration damping characteristics of metal core drumstick as compared with prior art wooden drumsticks. As is evident from the graph, the vibration characteristics of metal core drumsticks as disclosed herein are comparable to or superior than that of the prior art.

Finally, FIG. 7 compares the drumstick rebound speed of conventional wooden drumsticks with metal drumsticks constructed according to the present invention. As can be seen therein, the typical impact speed of 38.8 mph results in a 17.6 mph rebound speed for a wood drumstick and a 17.8 mph rebound speed for metal drumsticks according to the present invention. The rebound speed difference is negligible and the drumsticks constructed according to the invention therefore have essentially the same "feel" as wooden drumsticks.

Advantageously, the metal drumsticks of the present invention, having a removable sleeve 15, enable the replacement of the relatively inexpensive sleeve instead of the whole drumstick when worn. The urethane sleeve 15 also avoids damage to drums, cymbals, etc. caused by conventional drumsticks without sacrificing the performance characteristics thereof.

Persons skilled in the art will readily appreciate that various modifications can be made from the preferred embodiment thus the scope of protection is intended to be defined only by the limitations of the appended claims.

I claim:

1. A drumstick comprising:

a) an elongated metal core having a handle portion, an impact end and a tapered portion located between said handle portion and said impact end;

b) an elongated elastomeric sleeve removably mounted on said tapered portion of said metal core; and c) a rounded striking tip removeably affixed to the impact end of said core, said tapered portion of said metal core having a wall thickness that increases toward said impact end thereof.

2. The drumstick of claim 1 wherein said elastomeric sleeve is axially pre-stressed.

3. The drumstick of claim 2 wherein said rounded striking tip has an abutment shoulder engagable to retain said sleeve on said metal core.

4. The drumstick of claim 3 further comprising a slip ring having a sleeve abutment shoulder, said slip ring being removably mounted on a transition of said metal core between said handle portion and a smaller diameter cylindrical portion of said core which in turn extends between said handle portion and said tapered portion of said metal core, and said abutment shoulder abutting said sleeve to assist in axial pre-stressing thereof.

5. The drumstick of claim 4 wherein said slip ring has a tapered wall thickness that increases from said handle portion toward said impact end.

6. The drumstick of claim 5 wherein clearance exists between the interior wall of said abutment shoulder and said metal core.

7. The drumstick of claim 1 wherein said sleeve has a wall thickness that decreases toward said impact end.

8. The drumstick of claim 7 wherein said sleeve is urethane.

9. The drumstick of claim 8 wherein said metal core is aluminum or aluminum alloy.

10. The drumstick of claim 9 wherein said rounded striking tip is press-fit onto impact end of said metal core.

11. The drumstick of claim 10 wherein said rounded striking tip is an ovate nylon member.

12. The drumstick of claim 1 having a balance point located in the range of from 40–55% from said impact end of the drumstick.

13. The drumstick of claim 12 further comprising a mass of vibration damping material in said handle portion of said metal core.

14. The drumstick of claim 13 wherein said vibration damping material is a flexible sheet of rubberized material wound greater than 360° to provide overlap of the ends thereof.

15. The drumstick of claim 13 further comprising a plug in said handle for adjustable counterbalancing.

* * * * *